US010499722B2

(12) United States Patent
Squires

(10) Patent No.: US 10,499,722 B2
(45) Date of Patent: Dec. 10, 2019

(54) VENTILATED BACKPACK

(71) Applicant: Gregory A. Squires, St. Peters, MO (US)

(72) Inventor: Gregory A. Squires, St. Peters, MO (US)

( * ) Notice: Subject to any disclaimer, the term of this patent is extended or adjusted under 35 U.S.C. 154(b) by 0 days.

(21) Appl. No.: 16/130,600

(22) Filed: Sep. 13, 2018

(65) Prior Publication Data

US 2019/0075912 A1 Mar. 14, 2019

Related U.S. Application Data

(60) Provisional application No. 62/558,109, filed on Sep. 13, 2017.

(51) Int. Cl.
*A45F 3/04* (2006.01)
*A45F 3/12* (2006.01)

(52) U.S. Cl.
CPC ..... *A45F 3/04* (2013.01); *A45F 2003/125* (2013.01)

(58) Field of Classification Search
CPC ..... A45F 3/04; A45F 2003/125; A45F 2003/003; A45F 2003/122; A45F 2003/001; A41D 13/0025
See application file for complete search history.

(56) References Cited

U.S. PATENT DOCUMENTS 5,823,414 A * 10/1998 Gal ..... A45F 3/04 224/637
7,249,464 B1 * 7/2007 Watson ..... A45F 3/04 62/259.3
9,204,674 B2 * 12/2015 Bujold ..... A41D 13/0025
2004/0134955 A1 * 7/2004 Williams ..... A45F 3/04 224/644
2010/0116861 A1 * 5/2010 Burrowes ..... A45F 3/04 224/633
2015/0075185 A1 * 3/2015 Sims ..... F28F 1/00 62/3.5

(Continued)

FOREIGN PATENT DOCUMENTS

CN 205040889 U 2/2016
JP 2004147871 A 5/2004

(Continued)

OTHER PUBLICATIONS

Turbo Backpack on Digital Trends; Jun. 9, 2017, 5 pages.
Icoolpack Kickstarter Page; Jun. 9, 2017, 26 pages.

*Primary Examiner* — Corey N Skurdal
(74) *Attorney, Agent, or Firm* — Stinson LLP

(57) ABSTRACT

A backpack has an air flow guide panel connected to the rear side of a rear storage pocket of the backpack such that an air flow channel is defined between opposing surfaces of the air flow guide panel and the rear storage pocket. The air flow guide panel and the pocket are shaped and arranged to define an inlet opening and an outlet opening in fluid communication with the air flow channel. The inlet opening is located adjacent the bottom of the pocket and the outlet opening is spaced apart along the height of the pocket from the inlet opening toward the top of the pocket. A blower is supported on the backpack for blowing air through the air flow channel along a flow path extending from the inlet opening through the outlet opening.

19 Claims, 8 Drawing Sheets

(56) References Cited

U.S. PATENT DOCUMENTS

| | | | | |
|---|---|---|---|---|
| 2016/0157588 | A1* | 6/2016 | Ford | A45F 3/04 224/657 |
| 2016/0174691 | A1* | 6/2016 | Chapuis | A45F 3/047 224/605 |
| 2016/0206018 | A1* | 7/2016 | Barbret | A41D 13/0053 |
| 2016/0235186 | A1* | 8/2016 | Chueh | A45F 3/04 |
| 2017/0102214 | A1* | 4/2017 | Wright | F41H 1/02 |
| 2017/0181529 | A1* | 6/2017 | Tatsumi | A45F 3/047 |
| 2019/0093929 | A1* | 3/2019 | Ye | F25B 21/02 |

FOREIGN PATENT DOCUMENTS

| | | | |
|---|---|---|---|
| KR | 200411707 | Y1 | 3/2006 |
| KR | 200466701 | Y1 | 5/2013 |

* cited by examiner

VENTILATED BACKPACK

CROSS-REFERENCE TO RELATED APPLICATIONS

This application claims priority to U.S. Application Ser. No. 62/558,109, entitled Ventilated Backpack and filed Sep. 13, 2017, which is hereby incorporated by reference in its entirety.

FIELD

This disclosure generally relates to a backpack and more specifically to a ventilated backpack for cooling the back of a user while the backpack is supported on the user's back.

BACKGROUND

Backpacks are used to carry various items in many contexts in modern society. Even the professional class has begun to prefer backpacks to traditional briefcases for transporting items used in conducting business. Backpacks are unobtrusive to carry because they are supported on the back of the user, freeing up the user's hands for other purposes. However, backpacks can insulate the user's back and inhibit natural cooling of the back that occurs due to airflow over the back when the back is not covered by a backpack. The user's own body heat can increase the temperature of the back and cause the user to sweat.

SUMMARY

In one aspect, a backpack for being carried while engaging the back of a user comprises a pocket having a bottom, a top, and a height extending from the bottom to the top. The pocket defines a storage compartment and an access opening in communication with the storage compartment and includes a reclosable closure for selectively opening and closing the access opening. The pocket includes a rear portion extending along the height having a rearward facing air flow guide surface and a forward facing surface defining a portion of the storage compartment. At least one shoulder strap is connected to the pocket for suspending the backpack from a shoulder of the user such that the rear portion of the pocket is located adjacent the back of the user and the rearward facing air flow guide surface faces the back of the user. An air flow guide panel having a forward facing air flow guide surface is connected to the pocket such that the forward facing air flow guide surface is spaced apart in opposing relationship with the rearward facing air flow guide surface to define an air flow channel between the forward and rearward facing air flow guide surfaces. The air flow guide panel and the pocket are shaped and arranged to define an inlet opening and an outlet opening in fluid communication with the air flow channel. The inlet opening is located adjacent the bottom of the pocket and the outlet opening is spaced apart along the height of the pocket from the inlet opening toward the top of the pocket. A blower is supported on the backpack for blowing air through the air flow channel along a flow path extending from the inlet opening through the outlet opening.

Other aspects and features will be understood hereinafter.

BRIEF DESCRIPTION OF THE DRAWINGS

Corresponding reference characters indicate corresponding parts throughout the drawings.

DETAILED DESCRIPTION

Figure 1:
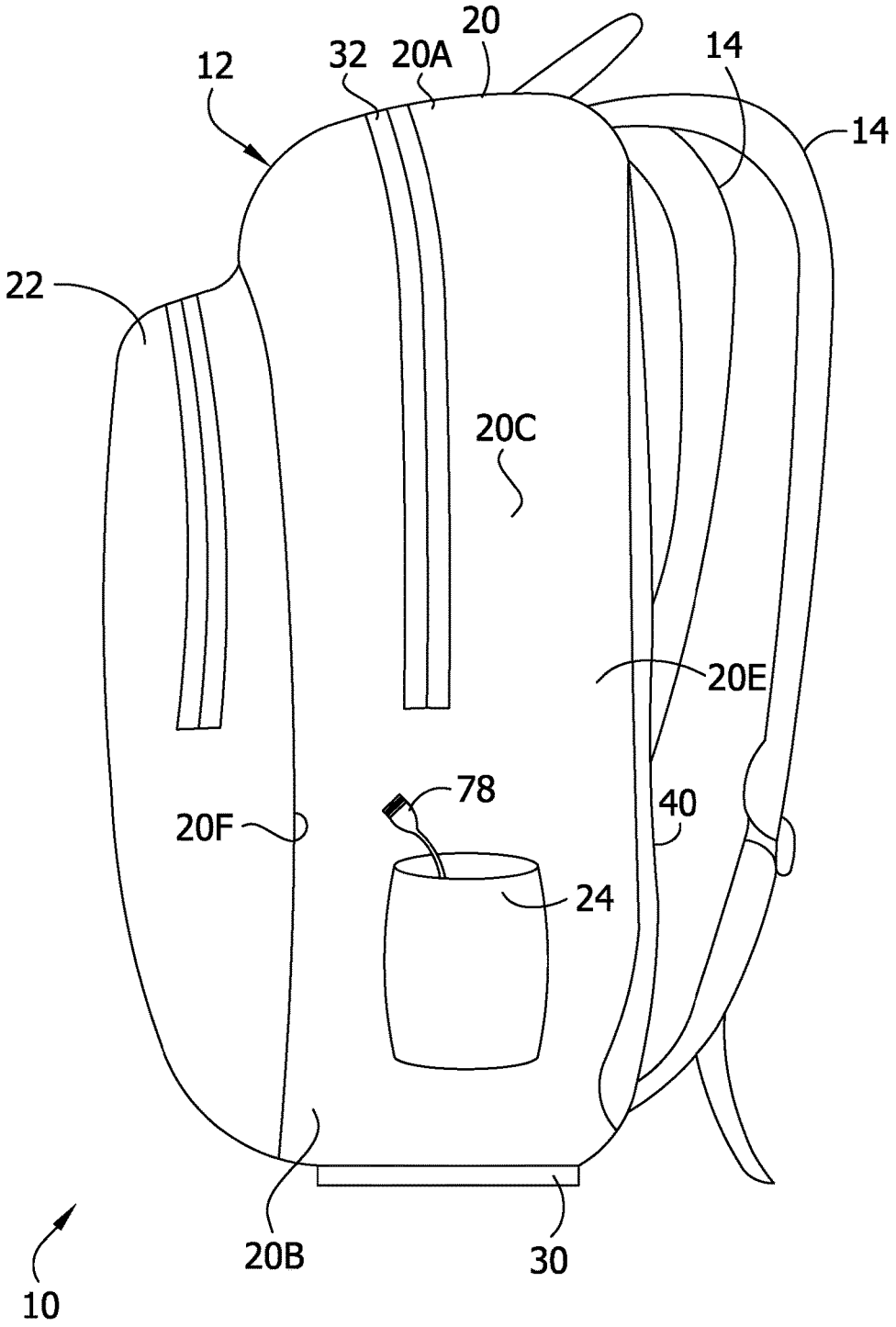
FIG. 1 is a side elevation of a backpack.
Figure 2:
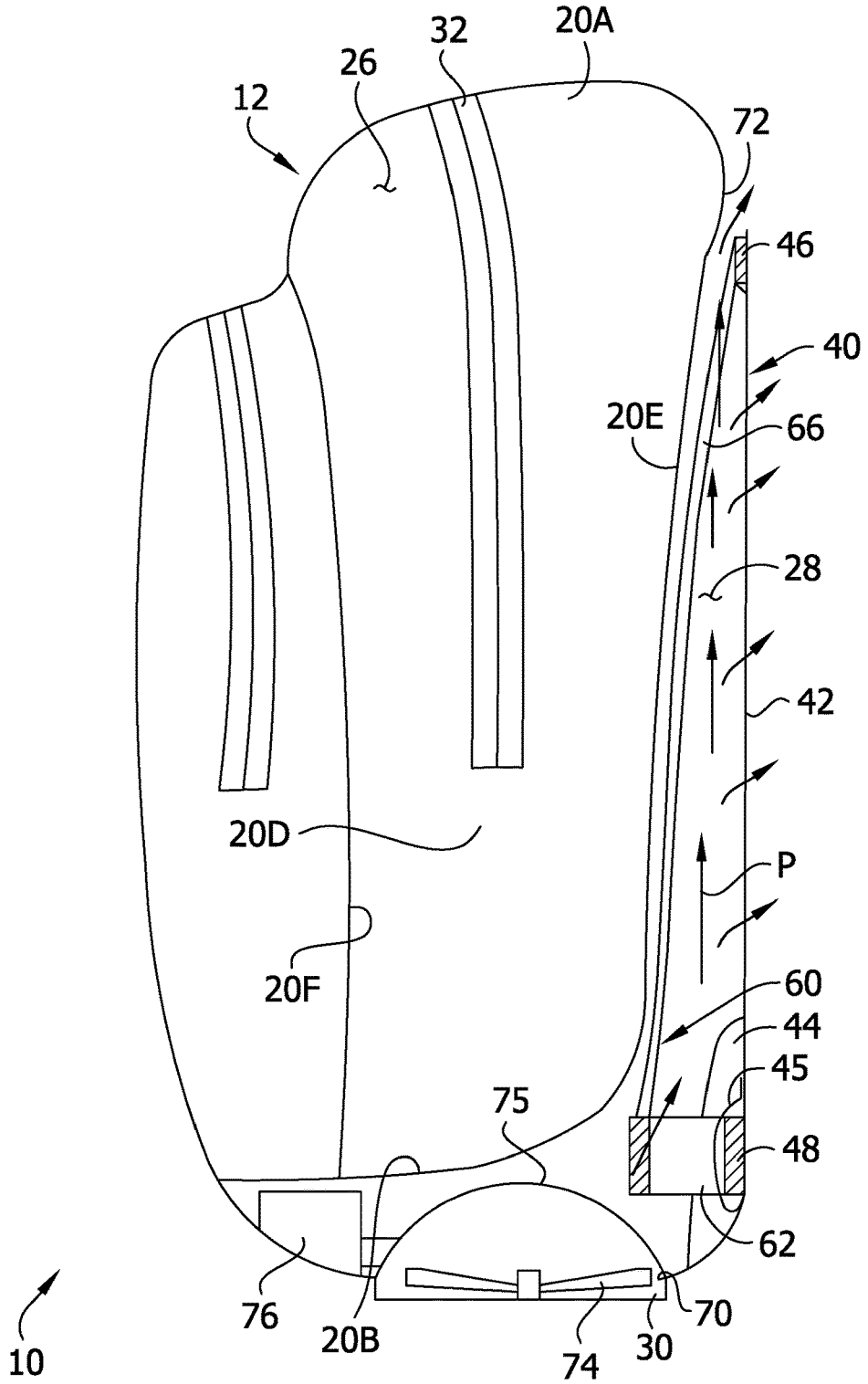
FIG. 2 is a vertical cross section of the backpack with shoulder straps thereof removed to illustrate other features more clearly.

Referring to FIGS. 1 and 2, one embodiment of a backpack is generally indicated at reference number 10. The backpack 10 comprises a bag, generally indicated at 12, and shoulder straps 14 secured to the bag for suspending the backpack from shoulders of the user so that the bag engages the back of the user. In the illustrated embodiment, the backpack 10 includes two shoulder straps 14, but it is understood that backpacks with only one shoulder strap can also be used without departing from the scope of the invention. The illustrated bag 12 includes a rear pocket 20, a front pocket 22, and a side pocket 24. It will be understood that backpacks having other numbers and arrangements of pockets can be used in other embodiments. The rear pocket 22 defines a rear storage compartment 26 (FIG. 2), which is the storage compartment positioned closest to the user's back when the backpack 10 is worn by the user. But unlike conventional backpacks, as described in greater detail below, the illustrated backpack 10 comprises an air flow channel 28 (FIG. 2) rearward of the rear storage compartment 26 that is configured to guide air blown by a blower 30 toward the user to provide cooling.

Throughout this disclosure terms such as "rear" and "rearward" refer to positions on the backpack 10 that are relatively near the user's back or to directions that face the user's back when the backpack is being worn. Terms such as "front" and "forward" refer to positions on the backpack that are relatively remote from the user's back or directions that face away from a user's back when the backpack is being worn.

The rear pocket 20 can be formed from one or more sheets of pliable material (e.g., a fabric such as canvas or the like), or a portion of or the entire pocket could be formed from rigid material. The pocket 20 has a top portion 20A, a bottom portion 20B, opposite first and second side portions 20C, 20D, a rear portion 20E and a front portion 20F. The front portion 20F of the rear pocket 20 also forms a rear wall of the front pocket 22 in the illustrated embodiment. The pocket 20 has a height extending from the bottom portion 20B to the top portion 20A and a width extending between opposite side portions 20C, 20D. The storage compartment 26 is defined by the top, bottom, front, rear, and opposite side portions 20A-20F of the pocket 20. The pocket 20 defines an access opening in communication with the storage compartment 26, which in FIGS. 1 and 2 is shown closed by a zipper 32 (broadly, a reclosable closure). The zipper 32 is configured to repeatably open and close the access opening. The bottom and rear portions 20B, 20E of the pocket 20 form a dividing wall between the storage compartment 26 and the air flow channel 28. More specifically, the rear portion 20E extends along the height and width of the pocket 20 and has a rearward facing air flow guide surface defining a portion of the air flow channel 28 and a forward facing surface defining a portion of the storage compartment 26. The bottom portion 20B likewise extends along the width of the pocket 20 and has a downward facing air flow guide surface defining a portion of the air flow channel 28 and an upward facing surface defining a portion of the storage compartment 26. It is also contemplated that in some embodiments only the rear portion of the pocket forms a dividing wall between the storage compartment and the air flow channel.

Figure 3A:
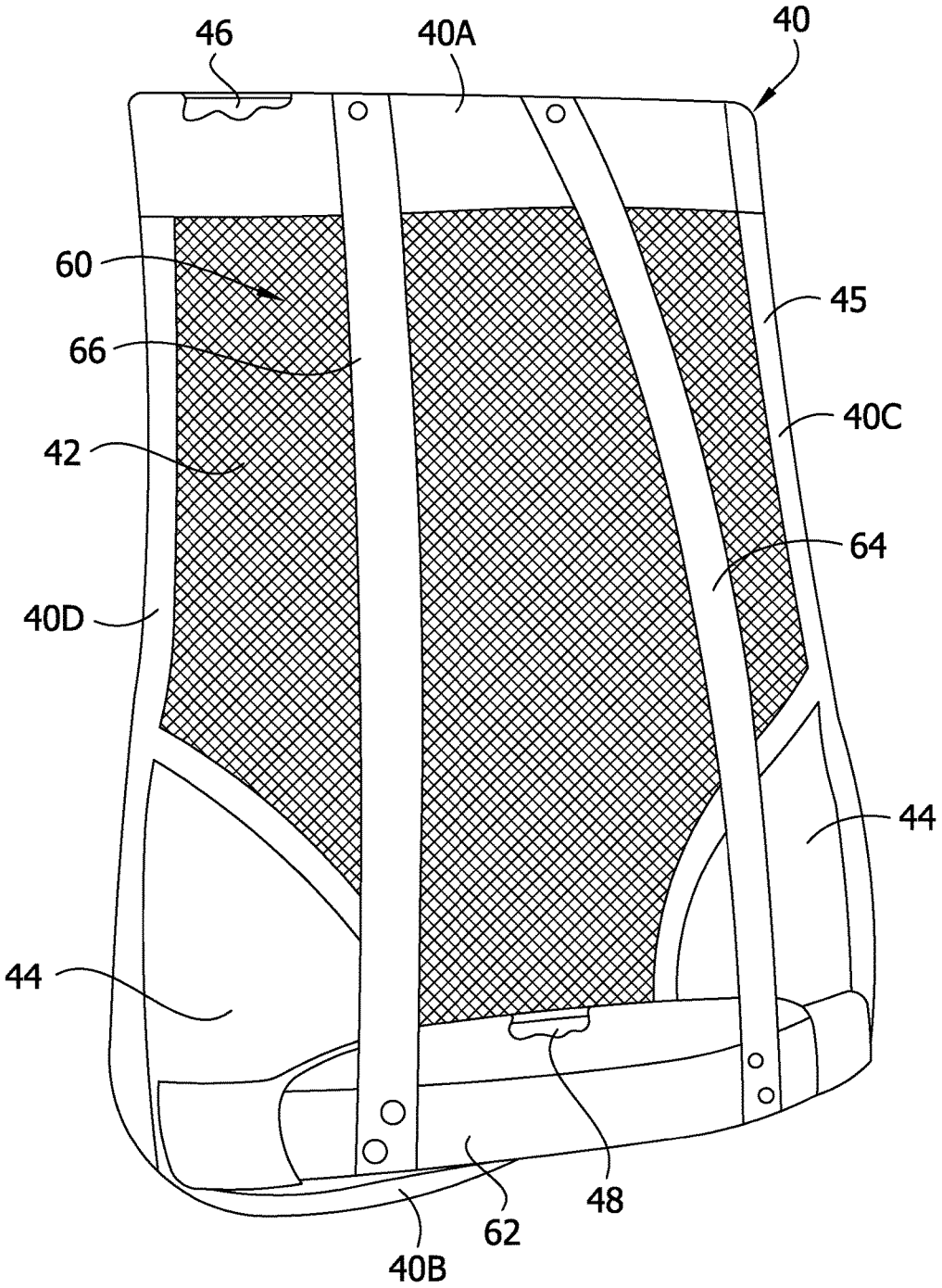
FIG. 3A is a fragmentary perspective of an air flow guide frame and air flow guide panel assembly of the backpack.
Figure 3B:
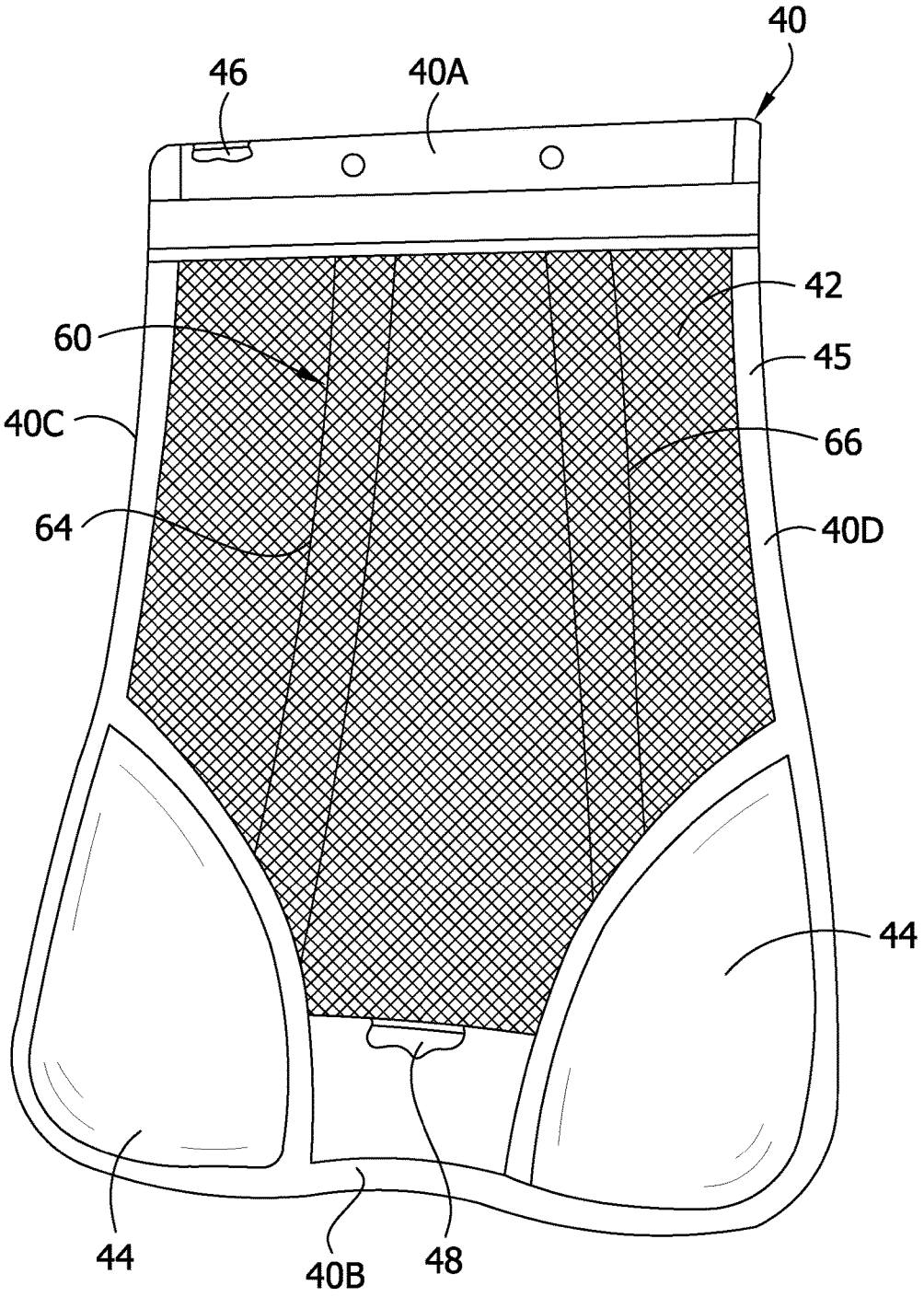
FIG. 3B is another fragmentary perspective of the assembly of FIG. 3A.

The backpack 10 also includes an air flow guide panel, generally indicated at 40, which is positioned rearward of the rear pocket 20. As shown in FIGS. 3A and 3B, the panel 40 has a top edge margin 40A and a bottom edge margin 40B that are spaced apart along a height (which extends generally parallel to the height of the rear pocket 20 when installed on the bag 12) and first and second and second side edge margins 40C, 40D spaced apart along a width (which extends generally parallel to the width of the rear pocket when installed on the bag). In general, the top, bottom, and side edge margins 40A-40D of the air flow guide panel 40 are aligned with the top, bottom, and side portions 20A-20D of the rear pocket 20 when the panel is installed on the bag 12. Referring to FIG. 2, the air flow guide panel 40 has a forward facing air flow guide surface and an opposite rearward facing surface. The forward facing air flow guide surface defines a portion of the air flow channel 28, and the rearward facing surface is configured for engagement with the back of the user when the shoulder straps 14 suspend the backpack 10 from the shoulders of the user. As explained below, the air flow guide panel 40 is connected to the rear pocket 20 such that the forward facing air flow guide surface is spaced apart in opposing relationship with the rearward facing air flow guide surface of the rear portion 20E of the pocket and the air flow channel 28 is defined between the forward and rearward facing air flow guide surfaces.

Figure 3C:
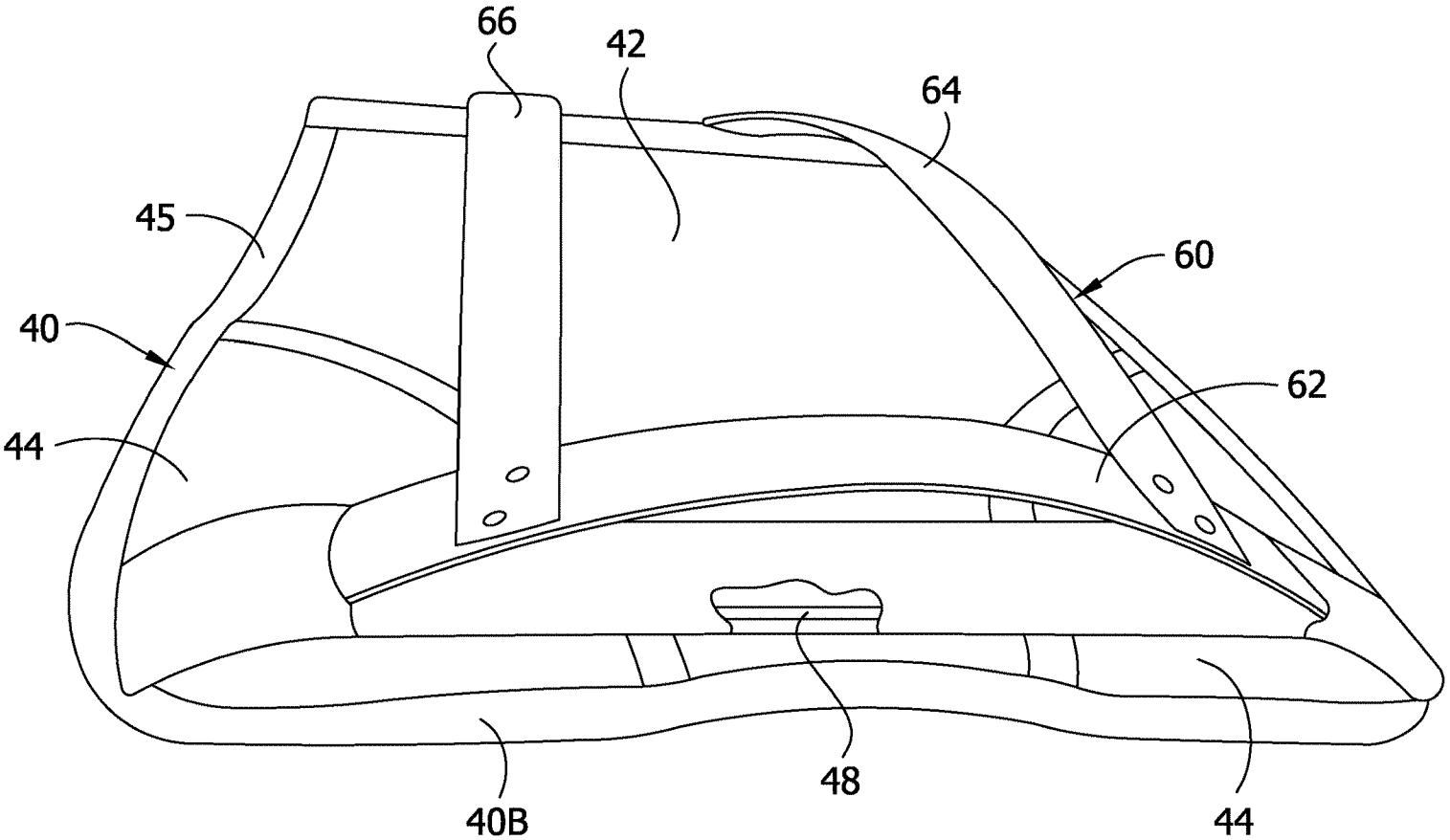
FIG. 3C is another fragmentary perspective of the assembly of FIG. 3A.

Referring to FIGS. 3A-3C, the illustrated air flow guide panel 40 comprises a mesh sheet 42 supported in a taught configuration. The mesh sheet 42 defines a portion of the forward facing air flow guide surface and the rearward facing surface of the panel 40. Moreover, the mesh sheet 42 defines a plurality of perforations extending through the thickness of the air flow guide panel 40 such that a portion of the air blown through the air flow channel 28 is discharged through the perforations (see FIG. 2) along the back of the user as described below. Although the illustrated air flow guide panel 40 is formed in part from a porous mesh sheet, other air flow guide panels can be substantially non-porous to limit air flow through the panel. In the illustrated embodiment the air flow guide panel 40 also includes two lumbar support pads 44 that are connected to the mesh sheet 42 adjacent the bottom edge margin 40B and first and second side edge margin 40C, 40D, respectively.

The illustrated panel 40 further includes hemmed fabric 45 extending around the perimeter edge margin of the panel for receiving support members 46, 48 that support the mesh sheet 42 in a taught configuration. A top support member 46 is received in the hemmed fabric 45 and extends along the width of the air flow guide panel 40 adjacent the top edge margin 40A thereof. Likewise, a bottom support member 48 is received in the hemmed fabric 45 and extends along the width of the air flow guide panel 40 adjacent the bottom edge margin 40B thereof. Each of the top and bottom support members 46, 48 comprises a strip of resilient material having a self-retaining form. Additional resilient support members (not shown; e.g., wires along the side edge margins 40C, 40D, etc.) can also be received in the hemmed fabric 45 without departing from the scope of the invention. In addition, it is understood that the support member(s) could be attached to the panel in other ways in other embodiments.

Referring again to FIGS. 1 and 2, the illustrated air flow guide panel 40 is connected to the pocket 20 at locations adjacent the first and second side portions 20C, 20D of the pocket such that the air flow channel 28 extends along a majority of the width of the pocket. More specifically, each of the first and second side edge margins 40C, 40D of the air flow guide panel 40 is connected to the rear portion 20E of the pocket 20 by a respective vertical seam (broadly, joining structure) adjacent the respective side portion 20C, 20D so that the air flow channel 28 extends between the seams along a majority of the width of the air flow guide panel. Any type of seam for securing the side edge margins 40C, 40D of the panel 40 to the pocket 20 (e.g., a stitched seam, an adhesive seam, a heat-bonded seam, etc.) can be used without departing from the scope of the invention. But in certain embodiments, the seams are configured so as to limit air flow through the seams.

Referring to FIGS. 2-3C, an air flow guide frame (broadly, a spacer), generally indicated at 60, is received in the air flow channel 28 for supporting the air flow guide panel 40 in spaced apart relationship with the rear portion 20E of the rear pocket 20. In the illustrated embodiment, the air flow guide frame 60 comprises a horizontal frame member 62 and first and second vertical frame members 64, 66, but other embodiments can include other numbers and arrangements of frame members. Each frame member 62, 64, 68 (each, broadly, a "spacer element") comprises a resilient strip of material having a self-retaining form in the assembled backpack 10.

The horizontal frame member 62 has a first end portion that is attached to the bottom support member 48 of the air flow guide panel 40 adjacent the first side edge margin 40C, a second end portion that is attached to the bottom support member adjacent the second side edge margin 40D, and a width extending between the first and second end portions. The horizontal frame member 62 has a bowed shape that extends forward away from the bottom support member 48 as it extends laterally inward from the first and second end portions where it is attached to the bottom support member. Thus, a middle portion of the horizontal frame member 62 is spaced apart forward of the air flow guide panel 40 for engaging the rear portion 20E of the pocket 20 to support the pocket in spaced apart relationship with the air flow guide panel.

Each of the first and second vertical frame members 64, 66 has a top end portion that is attached to the top support member 46, a bottom end portion that is attached to the horizontal frame member 62, and a height extending between the top and bottom end portions. The bottom end portions of the vertical frame members 64, 66 are attached to the horizontal frame member 62 at spaced apart locations between the end portions of the horizontal frame member and are thus spaced apart forward of the air flow guide panel 40. The vertical frame members 64, 66 extend forward away from the air flow guide panel 40 as they extend downward from the top end portions, where they are attached to the top support member 46. The vertical frame members 64, 66 are spaced apart from the air flow guide panel 40 along a majority of their heights. The vertical frame members 64, 66 are configured to engage the rear portion 20E of the pocket 20 to support the rear portion in spaced apart relationship with the air flow guide panel 40 for defining the air flow channel 28.

Figure 4:
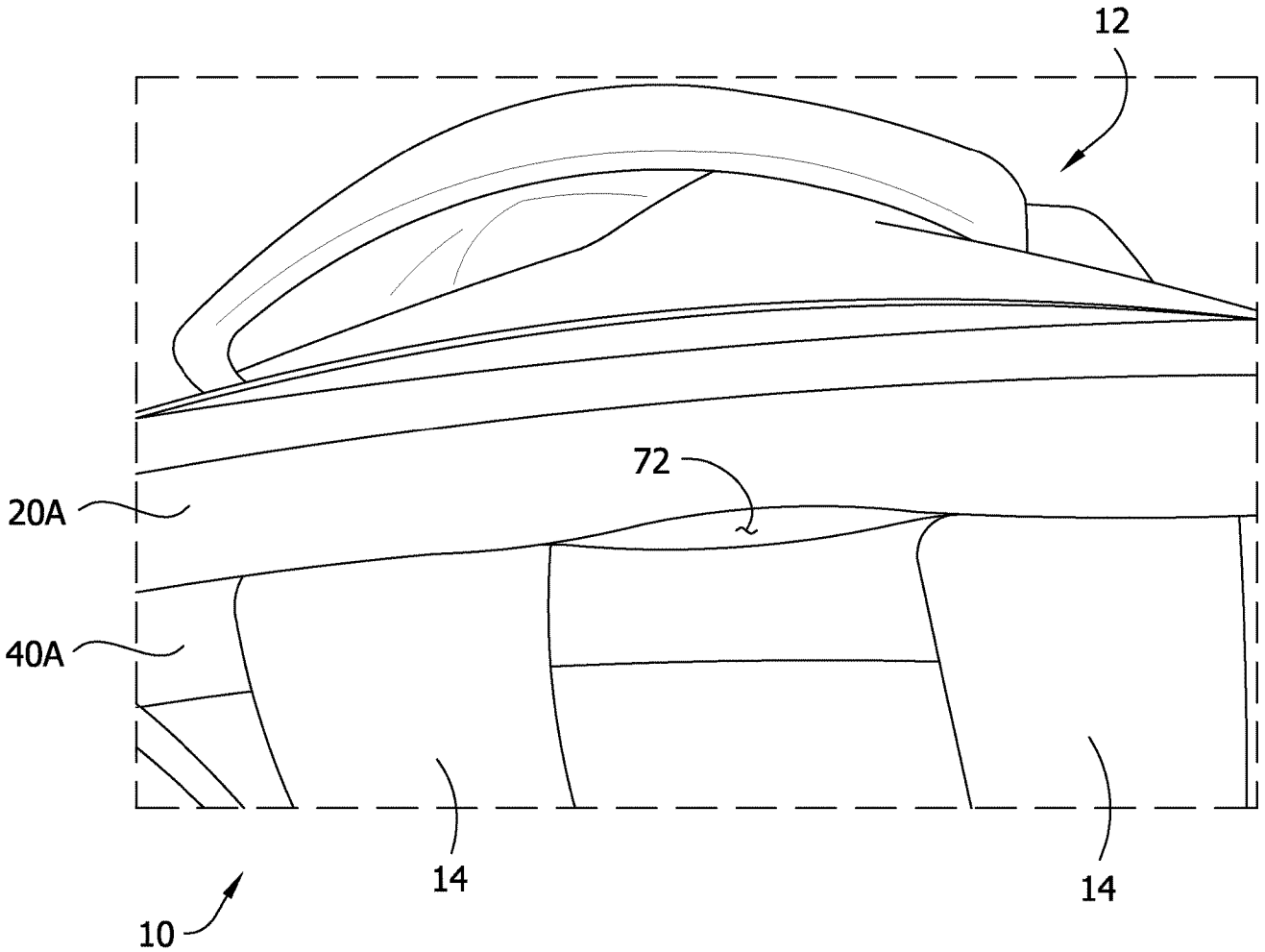
FIG. 4 is a partial perspective of the backpack illustrating an air flow outlet opening thereof.

Referring to FIG. 2, the air flow guide panel 40 and the rear pocket 20 are shaped and arranged to define an inlet opening 70 and at least one outlet opening 72 in fluid communication with the air flow channel 28. In the illustrated embodiment, the inlet opening 70 is formed in the bottom of the bag 12, below the bottom end portion 20B of the rear pocket 20. The inlet opening 70 is partly defined by the bottom edge margin 40B of the air flow guide panel 40. It is contemplated that in other embodiments, the inlet opening could be defined between the bottom edge margins of the rear portion of the rear pocket and the air flow guide panel or at other locations. Referring to FIG. 4, the top edge margin of the rear portion 20B of the pocket 20 and the top edge margin 40A of the air flow guide panel 40 are attached to one another at the opposite end portions thereof (adjacent the first and second side portions 20C, 20D and first and second edge margins 40C, 40D) and are unattached along middle segments of their widths extending between the opposite end portions. The unattached middle segments define the outlet opening 72. Thus, as shown in FIG. 2, an air flow path P through the air flow channel 28 extends vertically through the outlet opening 72. Moreover, because the vertical frame members 64, 66—which support the rear portion 20E of the pocket 20 to define the shape of the air flow channel 28—taper toward the air flow guide panel 40 as they extend toward their top end portions, the cross-sectional area of the air flow channel decreases along the flow path P, causing an acceleration in air flow through the outlet opening 72. It is understood that the backpack could have alternative or additional outlet openings in some embodiments. For example, in the illustrated embodiment, the perforations defined in the mesh panel 42 comprise additional outlet openings spaced apart along the height and width of the air flow guide panel 40. Still other outlet openings are also possible without departing from the scope of the invention.

In the illustrated embodiment, the blower 24 is mounted on the bag 12 adjacent the inlet opening 70 to blow air along the air flow path P extending from the inlet opening through the outlet opening 72. The illustrated blower 30 comprises two fans 74 mounted for rotation in an open fan housing 75 that is fastened to the bag 12. In one embodiment, a switch (not shown) for activating the fan is positioned on the bottom side of the fan housing 75, but it could have other positions in other embodiments. Other types of blowers, blowers fastened to the bag in other ways, and/or blowers mounted on the bag at other positions can also be used in other embodiments. A power supply 76 is supported on the backpack 10 for powering the blower 30. In one embodiment, the power supply comprises a lithium-ion battery. The blower 24 is operatively connected to the power supply 78 for drawing power from the power supply in use. Referring to FIG. 1, an electrical connector 78 (e.g., a USB connector) is also operatively connected to the power supply and configured for connection to an external electronic device (not shown; e.g., a phone) to allow the external electronic device to draw power from the power supply. In certain embodiments, the electrical connector 78 can also be connected to an external power supply (not shown) to charge the power supply 78.

In use, the user places items in the storage compartment 26 through the access opening in the pocket 20 and closes the zipper 32. The user then dons the backpack 10 so that the shoulder straps 14 suspend the bag 12 from the user's shoulders with the rear surface of the air flow guide panel 40 engaging the back of the user. If cooling air flow is desired, the user activates the blower 30 and the blower blows air through the air flow channel 28 along the air flow path P. The air travels vertically along the back of the user between the forward and rearward facing air flow guide surfaces of the rear portion 20E of the rear pocket 20 and the air flow guide panel 40, respectively. A portion of the blown air flows through the perforations in the mesh panel 42 to cool the user along a segment of the user's back. Another portion of the blown air accelerates through the outlet 72 toward the neck and head of the user. All the while, the pocket 20 maintains separation between the air flowing through the channel 28 and the items received in the storage compartment 26.

Figure 5:
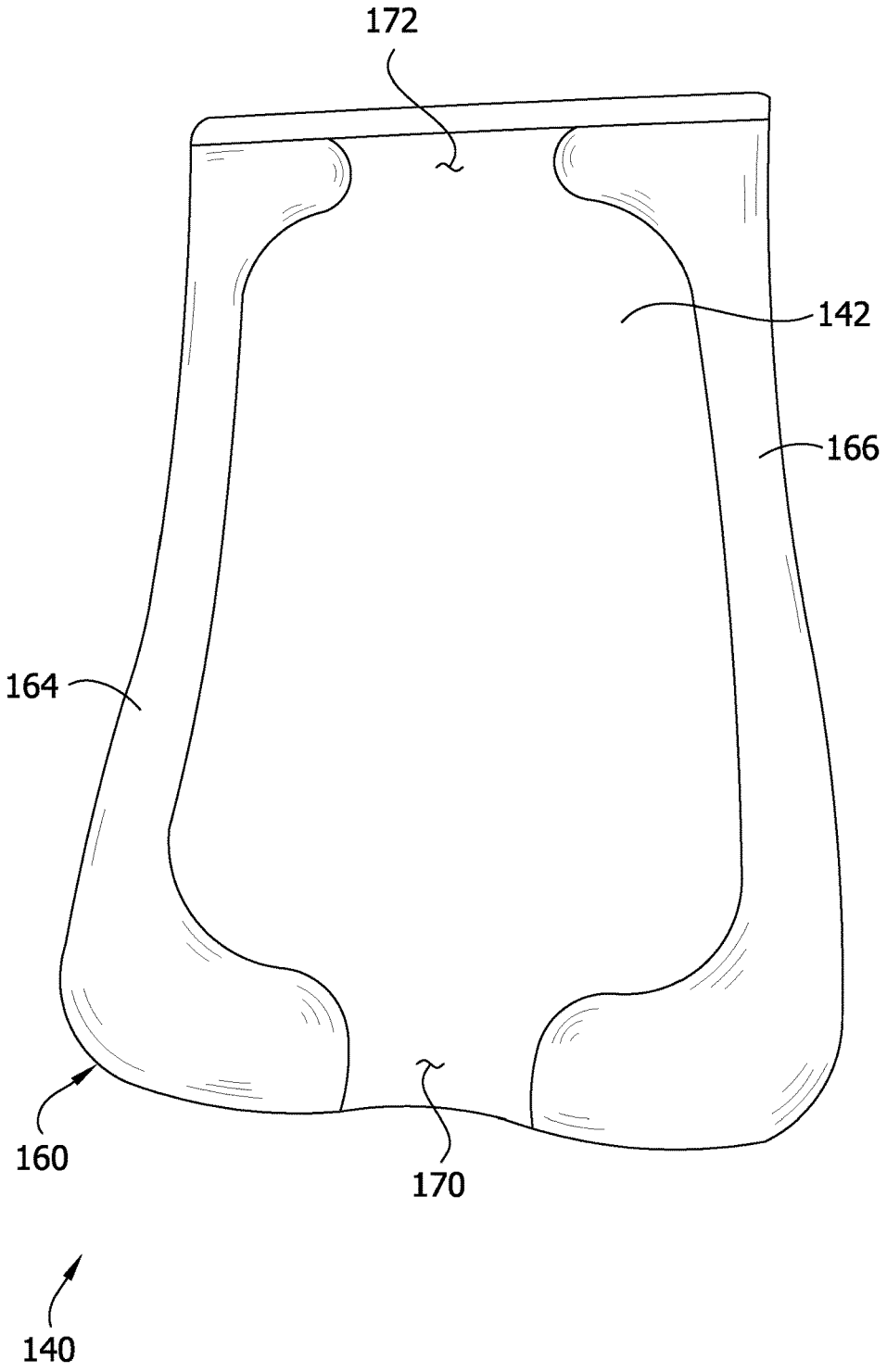
FIG. 5 is a perspective similar to FIG. 3A of an air flow guide panel of another embodiment of a backpack.
Figure 6:
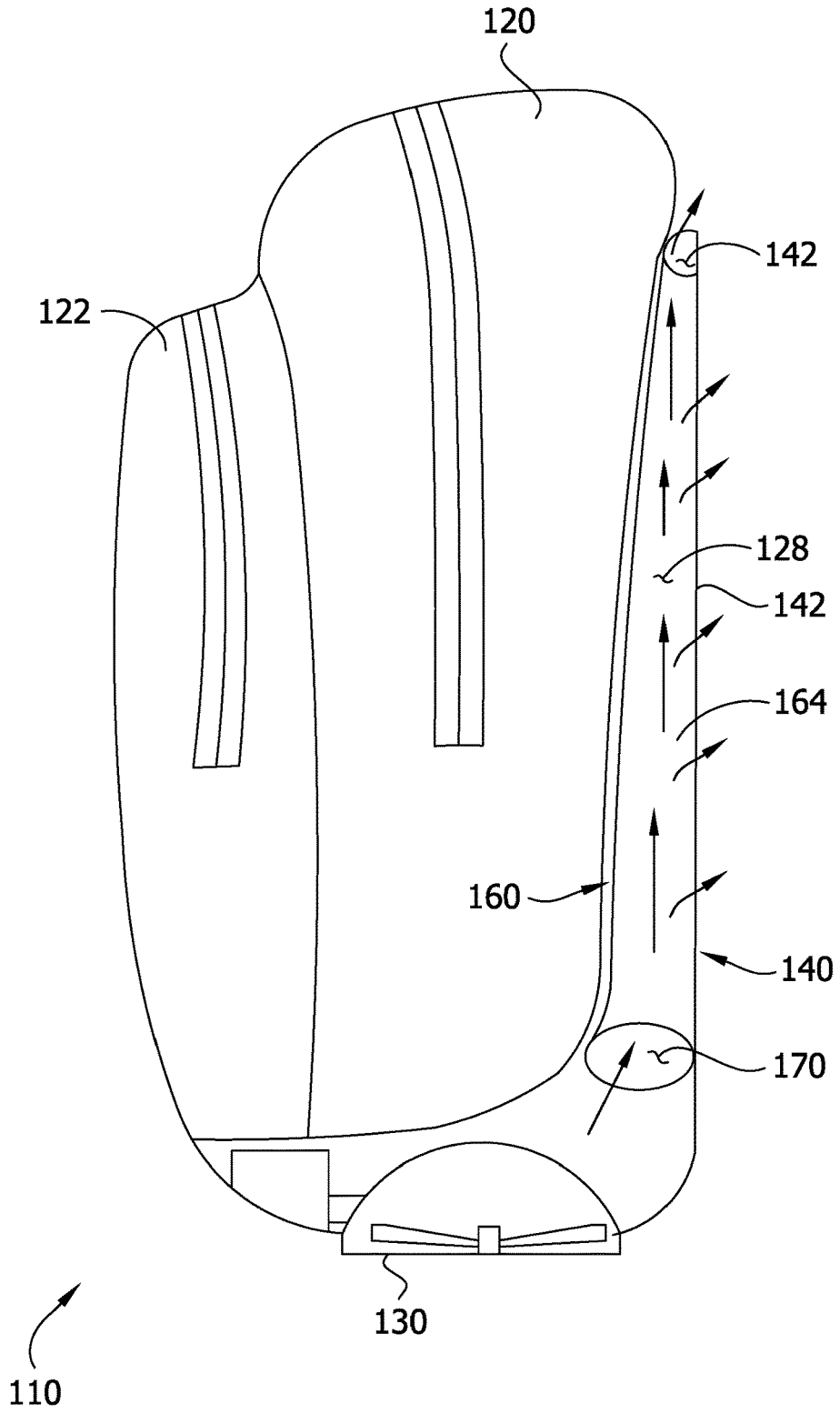
FIG. 6 is a vertical cross section similar to FIG. 2 of a backpack including the air flow guide panel of FIG. 5.

Referring to FIGS. 5 and 6, another embodiment of a backpack is generally indicated at reference number 110. The backpack 110 is similar in many respects to the backpack 10, and corresponding parts have corresponding reference numbers, plus 100. Like the backpack 10, the backpack 110 comprises storage pockets 120, 122 and an air flow channel 128 rearward of the rear storage pocket that is partially defined by an air flow guide panel 140. Like the air flow guide panel 40, the air flow guide panel 140 is configured to be mounted on the rear pocket 120 such that the forward facing air flow guide surface of the panel is spaced apart from a rear wall portion of the rear pocket and defines a portion of the air flow channel 128. In the illustrated embodiment, the air flow guide panel 140 includes a mesh sheet 142 that defines a portion of the air flow guide panel such that air can flow through the mesh sheet along the back of user when the backpack 110 is worn.

As in the backpack 10, in the backpack 110, a spacer 160 is configured to hold the air flow guide panel 140 in spaced apart relationship with the rear portion of the rear pocket 120. However, unlike the framework-type spacer 60, the spacer 160 comprises padding disposed between the air flow guide panel 140 and the rear pocket 120. In the illustrated embodiment, the padding 160 comprises first and second compressible pads 164, 166 (e.g., each comprising one or more pieces of foam; each, broadly, a 'spacer element') disposed generally along the side margins of the air flow guide panel 140 such that the air flow channel 128 is defined in the space laterally between the two pads. In one or more embodiments, the pads 164, 166 are connected to one of the air flow guide panel 140 and the rear storage pocket 120 by being sewn into pad-receiving pockets thereupon. The pads can be secured in position between the air flow guide panel in other ways in other embodiments (e.g., by adhesive, mechanical fasteners, etc.).

Suitably, the pads 164, 166 are sufficiently thick and resistant to compression (e.g., the spacer 160 has a self-retaining form) to hold the air flow guide panel apart from the rear portion for the rear pocket 120. In one or more embodiments, the air flow guide panel 140 is sufficiently taught so that the air flow guide panel remains spaced apart rearward of the rear portion of the rear pocket along the full width of the air flow channel 128 during use. Each of the illustrated foam pads 164, 166 has a vertical portion that extends along the respective side edge margin of the air flow guide panel 140, a top portion that extends laterally inward from the top end of the vertical portion, and a bottom portion that extends laterally inward from the bottom end of the vertical portion. In other embodiments, the pads can have other shapes without departing from the scope of the invention. The bottom portion of the foam pads 164, 166 are laterally spaced apart from one another to define an air inlet 170 through which the fan 130 is configured to force air into the air flow channel 128. The top portions of the foam pads 164, 166 are laterally spaced apart from one another to define an air outlet 172 through which air flowing along the air flow channel 128 is discharged onto the neck of a wearer of the backpack 110. In the illustrated embodiment, the fan 130 is mounted on the backpack 110 below the inlet 170 such that the fan blows air upward from below through the inlet, along the air flow channel 128, and out the outlet 172. In other embodiments, a blower could have other arrangements on the backpack. For example, a fan could be positioned in the air flow channel or adjacent the outlet in one or more embodiments such that air is drawn into the fan through the inlet at the bottom of the air flow guide panel and discharged from the fan through the outlet.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description shall be interpreted as illustrative and not in a limiting sense.

What is claimed is:

1. A backpack for being carried while engaging the back of a user, the backpack comprising:

a pocket having a bottom, a top, and a height extending from the bottom to the top, the pocket defining a storage compartment and an access opening in communication with the storage compartment and including a reclosable closure for selectively opening and closing the access opening, the pocket including a rear portion extending along the height having a rearward facing air flow guide surface and a forward facing surface defining a portion of the storage compartment;

at least one shoulder strap connected to the pocket for suspending the backpack from a shoulder of the user such that the rear portion of the pocket is located adjacent the back of the user and the rearward facing air flow guide surface faces the back of the user;

an air flow guide panel having a forward facing air flow guide surface connected to the pocket such that the forward facing air flow guide surface is spaced apart in opposing relationship with the rearward facing air flow guide surface to define an air flow channel between the forward and rearward facing air flow guide surfaces, the air flow guide panel and the pocket being shaped and arranged to define an inlet opening and an outlet opening in fluid communication with the air flow channel, the inlet opening being located adjacent the bottom of the pocket and the outlet opening being spaced apart along the height of the pocket from the inlet opening toward the top of the pocket; and a blower supported on the backpack for blowing air through the air flow channel along a flow path extending from the inlet opening through the outlet opening.

2. A backpack as set forth in claim 1, wherein the pocket further includes a first side portion and a second side portion defining a width of the pocket and the air flow guide panel is connected to the pocket at locations adjacent the first and second side portions, respectively, such that the air flow channel extends along a majority of the width of the pocket.

3. A backpack as set forth in claim 2, wherein the air flow guide panel has first and second side edge margins extending along the height of the pocket, each of the first and second side edge margins connected to the rear portion of the pocket by a respective joining structure defining a respective side of the air flow channel located adjacent a respective one of the first and second side portions of the pocket.

4. A backpack as set forth in claim 3, wherein the joining structure is configured to limit air flow through the joining structure.

5. A backpack as set forth in claim 1, further comprising a spacer having a self-retaining form configured to support the air flow guide panel in spaced apart relationship with the rear pocket.

6. A backpack as set forth in claim 5, wherein the spacer comprises first and second spacer elements extending vertically along the air flow guide panel at spaced apart locations along a width of the air flow guide panel.

7. A backpack as set forth in claim 6, wherein the first and second spacer elements have top portions that are laterally spaced apart from one another to define an outlet therebetween.

8. A backpack as set forth in claim 6, wherein the first and second spacer elements have bottom portions that are laterally spaced apart from one another to define an inlet therebetween.

9. A backpack as set forth in claim 6, wherein the first and second spacers define sides of the air flow channel.

10. A backpack as set forth in claim 6, wherein each of the first and second spacers includes a vertical portion that extends vertically along a side edge margin of the air flow guide panel and at least one of a top portion and a bottom portion that extends laterally inward from the vertical portion.

11. A backpack as set forth in claim 6, wherein each of the first and second spacers comprises a compressible pad.

12. A backpack as set forth in claim 11, wherein each compressible pad comprises foam.

13. A backpack as set forth in claim 11, wherein each compressible pad is sewn into a respective pocket on the air flow guide panel.

14. A backpack as set forth in claim 5, wherein the spacer comprises a frame.

15. A backpack as set forth in claim 14, wherein the frame comprises at least one bowed frame member.

16. A backpack as set forth in claim 14, wherein the frame comprises at least one vertical frame member and at least one horizontal frame member.

17. A backpack as set forth in claim 1, wherein each of the air flow guide panel and the rear portion of the pocket has a top end margin extending along a width between opposite first and second end portions, the top end margins being attached to one another at the opposite first and second end portions thereof and being unattached along segments of the widths extending between the opposite first and second end portions to define the outlet opening between said segments of the widths.

18. A backpack as set forth in any of claim 1, further comprising a power supply supported in the backpack, the blower being operatively connected to the power supply to draw power from the power supply.

19. A backpack as set forth in claim 18, further comprising an electrical connector configured for connection to an external electronic device and operatively connected to the power supply for drawing power from the power supply when connected to the external electronic device.

* * * * *